United States Patent [19]

Rizzitano et al.

[11] 4,098,607

[45] Jul. 4, 1978

[54] 18% NI-MO-CO MARAGING STEEL HAVING IMPROVED TOUGHNESS AND ITS METHOD OF MANUFACTURE

[75] Inventors: Fortunato J. Rizzitano, Needham, Mass.; Ernest P. Abrahamson, II, Chebeague Island, Me.

[73] Assignee: The United States of America as represented by the Secretary of the Army, Washington, D.C.

[21] Appl. No.: 738,797

[22] Filed: Nov. 4, 1976

[51] Int. Cl.[2] ..... B22F 3/00

[52] U.S. Cl. ..... 75/243; 75/214; 75/226

[58] Field of Search ..... 75/214, 226, 243

[56] References Cited

U.S. PATENT DOCUMENTS

| | | | |
|---|---|---|---|
| 3,099,041 | 7/1963 | Kaufmann | 264/.5 |
| 3,343,998 | 9/1967 | Abkowitz | 75/214 |
| 3,810,756 | 5/1974 | Koehler | 75/226 |
| 3,834,004 | 9/1974 | Ayer | 75/226 |
| 3,975,193 | 8/1976 | Nayar | 75/226 |
| 4,011,108 | 3/1977 | Hellman et al. | 75/226 |

OTHER PUBLICATIONS

Tracey et al., "Mechanical Properties of Some Maraging Steels", Powder Metallurgy, 12 (23) pp. 131–156 (1969).

Fisher; J. J., "Mechanical Properties of Sintered 18% Maraging Steel", Int'l. J. of Powder Metallurgy, 2 (4) pp. 37–42, Oct. 1966.

Pietrocini et al., Int. Journal Powder Metallurgy, vol. 6, #4, Oct. 1970, pp. 19–25.

*Primary Examiner*—Brooks H. Hunt

*Attorney, Agent, or Firm*—Nathan Edelberg; Robert P. Gibson; Lawrence E. Labadini

[57] ABSTRACT

An 18% Ni-Mo-Co maraging steel is processed to substantially increase its toughness (Charpy V-Notch) by heating the alloy in particle form to at least the solution treatment temperature thereof, quenching said alloy particles, compacting, and consolidating the quenched particles at a temperature within the recrystallization range of the alloy to form a consolidated product and aging the consolidated product.

9 Claims, No Drawings

18% NI-MO-CO MARAGING STEEL HAVING IMPROVED TOUGHNESS AND ITS METHOD OF MANUFACTURE

RIGHTS OF GOVERNMENT

The invention described herein may be manufactured and used by or for the Government for governmental purposes without payment of any royalties thereon or therefor.

BACKGROUND OF THE INVENTION

1. Field of Invention

The present invention is directed to an 18% Ni-Mo-Co maraging steel which possesses a substantially improved toughness. More particularly, the present invention relates to a method for processing an 18% Ni-Mo-Co maraging steel to obtain a product which possesses the best combination of tensile strength and toughness.

2. Description of the Prior Art

The alloy compositions of the commercial 18% Ni-Mo-Co maraging steels are designed to provide maximum toughness at strength levels of 200–350 ksi. They owe their unique properties to a tough ductile iron-nickel martensite structure which age hardens at approximately 900° F. The primary precipitate responsible for the strengthening of the steel is $Ni_3Mo$. Cobalt enhances the effect of $Ni_3Mo$ by decreasing the solubility of molybdenum in the matrix. $Ni_3Ti$ also has been identified in maraging alloys, but it is believed to be a secondary precipitation hardening reaction product.

Strength of these materials is also increased by raising the titanium content in base compositions that are progressively slightly enriched in nickel, cobalt and molybdenum to maintain the optimum toughness. However, at and above a 300-ksi yield strength, the enriched compositions are subject to austenite retention at regions of alloy segregation.

SUMMARY OF THE INVENTION

Accordingly, it is an object of the present invention to provide a process for treating 18% Ni-Mo-Co maraging steels to produce a steel which possesses a substantial improvement in toughness.

Another object of the present invention is to provide an 18% Ni-Mo-Co maraging steel which possesses the best combination of tensile strength and toughness.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

Pursuant to the present invention, 18% Ni-Mo-Co maraging steels are processed to substantially increase their toughness (Charpy V-Notch) while at the same time obtaining the best combination of toughness and tensile strength by homogenizing the alloy to a powder form to eliminate the microsegregation commonly found in 18% Ni-Mo-Co maraging steel, compacting and consolidating the powdered particles, for example, by extrusion, at a temperature within the recrystallization range of the alloy and heattreating or aging the alloy at a temperature of about 800°–1000° F, preferably about 900° F, for a period of about 3 hours. In the homogenization of the alloy, the 18% Ni-Mo-Co maraging steel is converted to powder form in the manner set forth in U.S. Pat. No. 3,099,041 to Kaufmann which utilizes the REP (rotating electrode process) powder technique for reducing the alloy to powder form. This process includes a liquid atomizing of the alloy followed by a subsequent quenching procedure. Any titanium nitrides and carbides in the alloy are maintained in a fine homogeneous manner, and, with a fine dendrite formation, establish a large number of future nucleation sites for the later aging of the final product.

The powdered alloy thus obtained is then blended, as desired, and subsequently is heated, compacted, consolidated, and bonded by a hot-plastic deforming procedure, for example, by extrusion at a temperature within the recrystallization temperature range of the alloy to form a consolidated product. Recrystallization occurs when heating in the furnace to a temperature of about 1625°–1675° F. Extrusion of the powder particles at the recrystallization temperature, advantageously at a temperature of about 1650° F., reduces the strain in the lattice due to work hardening at lower temperatures and maintains the original dendrite structure and thus also maintains the nucleation sites which would be lost at higher temperatures.

The compaction and consolidation step is followed by a final heat treatment or aging of the product for an extended period of time, for example, at a temperature of about 900° F. for a period of about 3 hours.

The maraging steel which is utilized in the present invention is a standard commercial alloy with established composition ranges or maxima as shown in Table I.

EXAMPLES OF THE INVENTION

The following examples are given merely as illustrative of the present invention and are not to be considered as limitative. Unless otherwise noted, the percentages recited therein are by weight.

TABLE I

| | Chemical Composition (% by weight) | | | |
|---|---|---|---|---|
| Element | Grade 200 (all types) | Grade 250 (all types) | Grade 300 (all types) | Check Analysis Permissible Variation (all grades and types) |
| Nickel | 17.0 - 19.0 | 17.0 - 19.0 | 18.0 - 19.0 | ±0.15 |
| Cobalt | 8.0 - 9.0 | 7.0 - 8.5 | 8.5 - 9.5 | ±0.10 |
| Molybdenum | 3.0 - 3.5 | 4.6 - 5.2 | 4.6 - 5.2 | ±0.10 |
| Titanium | 0.15 - 0.25 | 0.3 - 0.5 | 0.5 - 0.8 | ±0.05 |
| Aluminum | 0.05 - 0.15 | 0.05 - 0.15 | 0.05 - 0.15 | ±0.03 |
| Carbon | 0.03 Maximum | 0.03 Maximum | 0.03 Maximum | +0.005 |
| Manganese | 0.10 Maximum | 0.10 Maximum | 0.10 Maximum | +0.03 |
| Silicon | 0.10 Maximum | 0.10 Maximum | 0.10 Maximum | +0.02 |
| Phosphorus | 0.01 Maximum | 0.01 Maximum | 0.01 Maximum | +0.002 |
| Sulfur | 0.01 Maximum | 0.01 Maximum | 0.01 Maximum | +0.002 |
| Residual Elements | — | — | — | |
| Iron | Balance | Balance | Balance | |
| Selectable allowable maximum additions: | | | | |

TABLE I-continued

| Element | Chemical Composition (% by weight) Grade 200 (all types) | Grade 250 (all types) | Grade 300 (all types) | Check Analysis Permissible Variation (all grades and types) |
|---|---|---|---|---|
| Boron | 0.003 | 0.003 | 0.003 | |
| Zirconium | 0.020 | 0.020 | 0.020 | Certified as |
| Calcium | 0.050 | 0.050 | 0.050 | Additional only |

EXAMPLES

In accordance with the present invention, and in further illustration thereof, a typical 18% Ni-Mo-Co maraging steel is processed following the procedure set forth hereinabove. This steel has the following composition:

| | | |
|---|---|---|
| C = 0.012% | Mo = 4.80% | Al = 0.10% |
| Si = 0.05% | Co = 8.80% | Ti = 0.70% |
| Mn = 0.07% | Ni = 18.05% | B = 0.003% |
| S = 0.006% | Ca = 0.05% | Zr = 0.009% |
| P = 0.004% | | |

The 18% Ni-Mo-Co maraging steel is first converted to a quenched particle form. This may be accomplished by a liquid atomizing and quenching procedure such as that disclosed in U.S. Pat. No. 3,099,041, to produce quenched fine metallic powder, particles, or "shot" of the alloy material of uniform character and properties and, for example, not exceeding a size of about 200 microns in diameter. An example of the procedure for converting the alloy material to particle form involves rotating, heating and melting the alloy material to form liquid drops within a controlled atmosphere chamber, and casting off the liquid drops by centrifugal force into a quenching environment, whereby the drops are immediately and uniformly quenched to produce particles having uniform melt-treated and quenched properties of the alloy material, said properties being uniform throughout each particle and from particle to particle.

After the alloy has been converted to powder form, said powder is divided into four equal portions and blended in a V-cone blender prior to being placed in an extrusion can, evacuated and sealed. The blended mixture is then introduced into cans or containers, preferably formed of seamless, low-carbon steel tubing and welded-in end plates. One end plate is welded to the tubing prior to filling, and after the container is completely filled with alloy particles, the other end plate is welded to the other end of said tubing. The container thus formed and filled with alloy particles is then heated at about 1500° F. for about 3 hours. It is then compacted at a force of about 90 tsi, ejected, and quenched, and is then machined to form a billet suitable for further extrusion operations. The hot, compacted billet thus formed, after proper machining to accommodate subsequent extrusion operations, is then repeatedly extruded, while jacketed or canned, through a number of reductions to form extruded rods in the manner described in detail in U.S. Pat. No. 3,343,998 to Abkowitz, with the exception of the temperature at which the extrusion is to be performed. That is, according to the present invention, the extrusion is conducted at the recrystallization temperature of the alloy material rather than at the aging temperature thereof.

The billet is heated to the desired temperature and then extruded in a press to radially reduce and longitudinally elongate the billet. It may then be reheated and again extruded. The number of heating and extruding operations performed to reduce the billet containing compacted alloy particles and to consolidate said particles to form a solid billet depends upon the power of the extrusion equipment utilized. It has been found that at least a 10:1 reduction in area of the billet is advantageous in obtaining full and complete consolidation of the alloy particles so that a solid mill product is formed. After the extrusion and consolidation have been completed, the mild steel elements, that is, the tubing and end plates, are stripped from the consolidated products, which is then aged, for example, at a temperature of about 900° F., for a period of about 3 hours. The temperatures and other extrusion data are shown in Table II.

TABLE II

| Billet No. | Extrusion Temperature (° F.) | Ram Speed (in/min) | Extrusion Data: Extrusion Force (tons) Upset | Extrusion Force (tons) Running | Extrusion Constant (psi) Upset | Extrusion Constant (psi) Running |
|---|---|---|---|---|---|---|
| 1 | 1650 | 100 | 825 | 735 | 35.7 | 32.6 |
| 2 | 1400 | 100 | 1110 | 950 | 47.7 | 40.8 |
| 3 | 1400 | 220 | 1110 | 965 | 47.7 | 41.5 |
| 4 | 1400 | 400 | 1130 | 1000 | 48.5 | 43.0 |

The specimens were tested in two conditions:
Treatment A - as extruded and aged 3 hours at 900° F.
Treated B - as extruded, solutionized at 1500° F. for 1 hour, water quenched and aged 3 hours at 900° F. This treatment is used on conventional wrought 18% Ni Mar 300 maraging steel.

When consolidated and extruded, the power structure is completely lost. The 1650° F. extrusion is recrystallized and the blocky precipitates are still randomly dispersed. However, at 1400° F. and 100 in/min., the grains are elongated and the precipitate appears in stringers. Additionally, a second precipitate, $Ni_3Mo$, starts to appear. As the speed of extrusion is increased to 400 in/min. at 1400° F., the structure becomes a combination of elongated and recrystallized grains, with no indication of $Ni_3Mo$ and a decreasing number of TiN and TiC stringers. In the lower temperature extrusions there is more massive precipitation of $Ni_3Mo$ along the bands of TiN than in the 1650° F. extrusion.

Room temperature tensile tests, Charpy V-Notch, and hardness measurements were run on extrusions 1, 2 and 4. The as-extruded hardness for all three was Rc 32. The properties for the heat-treated materials formed above and a comparison with commercial material are given in Table III.

Within experimental error, the hardnesses are essentially the same for all treatment conditions. The yield strengths in the aged and 1500° F. solution treated and aged conditions are slightly higher than the commercial material (at best 10%). However, the toughness of all three extrusions in these conditions equaled or bettered that of the commercial material. The as-extruded and aged material for the 1400° F. extrusions nearly doubled the results for commercial 18 NiMar 300, while the 1650° F. extrusion more than tripled the Charpy V-Notch value. As will be noted, in the latter instance, the Charpy V-Notch toughness of the alloy was increased from 7 ft-lbs to 23 ft-lbs and at the same time the ultimate tensile strength of the alloy increased from 273 ksi to 282 ksi. This results in an excellent combination of tensile strength and toughness never heretofore attainable by an 18% Ni-Mo-Co steel.

The fracture surfaces varied with the extrusion conditions and heat treatment. The material extruded at 1650° F. showed a normal fine grain fracture on the Charpy specimens. The lower temperature extrusions had fibrous fractures, with the material extruded at 400 in/-min showing a combination of fibrous and fine grain fracture. With an increase in the solution treatment temperature, the fibrosity was seen to decrease.

TABLE III

Mechanical Properties for 18 Ni MAR 300 Under Various Conditions

| Material | Heat Treatment (° F.) | Heat Treatment (hr) | 0.1% Yield Stress (ksi) | 0.2% Yield Stress (ksi) | Ultimate Tensile Stress (ksi) | Elongation (%) | Reduction of Area (%) | charpy V-Notch (Rm. Temp.) (ft-lb) | $R_c$ hardness |
|---|---|---|---|---|---|---|---|---|---|
| Commercial 300 Grade | 1500 | 1-W.Q.[1] | 265 | 266 | 273 | 11.5 | 40 | 7 | 51 |
| Starting Material | 900 | 3-A.C.[2] | | | | | | | |
| REP[3] 300 Grade | 900 | 3-A.C. | 270 | 278 | 282 | 10.0 | 54 | 23 | 52 |
| Extruded at | 1500 | 1-W.Q. | 282 | 289 | 293 | 10.0 | 40 | 11 | 54 |
| 1650° F, 100 in/min and W.Q. | 900 | 3-A.C. | | | | | | | |
| REP[3] 300 Grade | 900 | 3-A.C. | 265 | 272 | 277 | 12 | 46 | 13 | 52 |
| Extruded at | 1500 | 1-W.Q. | 275 | 282 | 284 | 10 | 46 | 7 | 53 |
| 1400° F, 100 in/min and W.Q. | 900 | 3-A.C. | | | | | | | |
| REP[3] 300 Grade | 900 | 3-A.C. | 266 | 274 | 276 | 12 | 49 | 13 | 52 |
| Extruded at | 1500 | 1-W.Q. | 272 | 279 | 282 | 11 | 44 | 9 | 53 |
| 1400° F, 400 in/min W.Q. | 900 | 3-A.C. | | | | | | | |

[1]W.O. = Water quenched
[2]A.C. = Air cooled
[3]REP = Rotating electrode process powder The processing of the powders by the rotating electrode process has alleviated the problem of alloy segregation which causes "banding" in commercial material. However, the microstructures and properties indicate that care must be taken to control fibering of TiN and TiC particles. Consider the material extruded at 1650° F — 100 in/min, 1450° F — 400 in/min, and 1400° F — 100 in/min as three stages of the fibering sequence. It is felt the 1400° F — 400 in/min falls midway between 1400° F and 1650° F due to the additional adiabatic heating at the faster rate of extrusion. This indicates that the matrix must be reasonably soft, i.e., at the recrystallization temperature, to avoid fibering.

The best combination of strength and toughness was observed in all cases for the as-extruded and aged condition. Solutionizing at 1500° F. plus aging refines the lath martensite structure and gives a finer $Ni_3Mo$ precipitate which further increases the strength, but decreases the toughness. Coarsening the structure by higher solutionizing temperatures reduces the strength and increases the toughness. Increasing temperature also decreases the fibering.

The conversion of the alloy material to quenched separate particles form has been described as being accomplished by atomizing and liquid quenching. This has the advantages that the quenched particles, powder or "shot" produced in this manner have smooth surfaces and no pyrophoricity, and are of high purity. Thus, the particles may be handled easily after conversion to particle form and in charging the billets. However, it is to be understood that quenched particles of the alloy material may be manufactured by other means. Thus, the alloy material may be converted to particle form in some other desired manner, then heated to render said particles molten, and then quenched to provide alloy material in quenched particle form, care being taken to maintain cleanliness and prevent contamination of the material during such particle preparation.

The compacting and consolidating of the quenched particles of the alloy material has been described preferably as being carried out by extrusion procedures. It is to be understood, however, that reductions and plastic deformation may also be accomplished on equipment other than an extrusion press and that plastic deformation or hot working may also be carried out on forging or rolling equipment sufficiently powerful to impart the necessary pressures to obtain hot working and reduction to the necessary degree and within the temperature limitations which must be observed.

The term "recrystallization temperature" is employed in the Specification and Claims in its ordinary and accepted meaning, i.e., heating a material having a distorted structure to a temperature which, after cooling, has an equiaxed structure different from that initially present therein.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. A process for producing an 18% Ni-Mo-Co maraging steel alloy of improved toughness which comprises blending smooth surfaced particles of 18% Ni-Mo-Co maraging steel alloy, compacting said particles, consolidating said particles at the recrystallization temperature of said steel alloy particles in the range of 1625°–1675° F to form a consolidated product and aging said consolidated product.

2. A process according to claim 1 wherein the consolidated product is aged at a temperature of about 900° F. for about 3 hours.

3. A process according to claim 2 wherein the consolidation is effected by extrusion.

4. A process according to claim 3 wherein said particles of steel alloy after blending are inserted into a mild steel extrusion can which is evacuated and sealed.

5. A process according to claim 4 wherein said steel alloy particles are formed by atomization of said steel alloy in liquid form and subsequent quenching in a cooling environment.

6. A process according to claim 5 wherein said steel alloy particles do not exceed a size of about 200 microns in diameter and wherein said compacting of said particles occurs at a temperature of about 1500° F.

7. A process according to claim 6 wherein said consolidation by extrusion is continued until at least a 10:1 area reduction has been achieved and wherein said consolidation occurs at a temperature of about 1650° F.

8. The product produced by the process of claim 2.

9. An 18% Ni-Mo-Co maraging steel alloy having a Charpy V-Notch toughness of 23 ft.-lbs., an ultimate tensile strength of 282 ksi and having a normal fine grain fracture on the Charpy specimens.

* * * * *